US011273385B2

(12) United States Patent
Tang et al.

(10) Patent No.: US 11,273,385 B2
(45) Date of Patent: Mar. 15, 2022

(54) METHOD FOR IMPROVING HEALTH OF ELDERLY PERSON BASED ON 5G SIGNAL TRANSMISSION TECHNOLOGY

(71) Applicant: Guangdong Polytechnic Normal University, Guangzhou (CN)

(72) Inventors: Yu Tang, Guangzhou (CN); Shaoming Luo, Guangzhou (CN); Qiwei Guo, Guangzhou (CN); Xincai Zhuang, Guangzhou (CN); Jiahao Li, Guangzhou (CN); Jiepeng Yang, Guangzhou (CN); Yiqing Fu, Guangzhou (CN); Chaojun Hou, Guangzhou (CN); Jiajun Zhuang, Guangzhou (CN); Aimin Miao, Guangzhou (CN); Xuan Chu, Guangzhou (CN); Huasheng Huang, Guangzhou (CN)

(73) Assignee: GUANGDONG POLYTECHNIC NORMAL UNIVERSITY, Guangzhou (CN)

( * ) Notice: Subject to any disclaimer, the term of this patent is extended or adjusted under 35 U.S.C. 154(b) by 0 days.

(21) Appl. No.: 17/343,726

(22) Filed: Jun. 9, 2021

(65) Prior Publication Data

US 2022/0040588 A1 Feb. 10, 2022

(30) Foreign Application Priority Data

Aug. 5, 2020 (CN) ..... 202010775324

(51) Int. Cl.
*A63G 31/16* (2006.01)
*G08C 17/02* (2006.01)

(52) U.S. Cl.
CPC ..... *A63G 31/16* (2013.01); *G08C 17/02* (2013.01)

(58) Field of Classification Search
CPC ..... A63G 31/16; G08C 17/02; G06T 19/03; G06T 19/006; G01C 21/3667; A63J 5/021; A63H 13/005
See application file for complete search history.

(56) References Cited

U.S. PATENT DOCUMENTS

| | | | | |
|---|---|---|---|---|
| 10,695,689 | B2 * | 6/2020 | Weston | A63G 31/16 |
| 2017/0103571 | A1 * | 4/2017 | Beaurepaire | G01C 21/3667 |
| 2019/0102684 | A1 * | 4/2019 | Beran | H04L 67/22 |

* cited by examiner

*Primary Examiner* — Vernal U Brown
(74) *Attorney, Agent, or Firm* — Getech Law LLC; Jun Ye

(57) ABSTRACT

A method for improving health of an elderly person based on a 5G signal transmission technology includes: acquiring by a real terminal a first sensing signal set; modifying the first sensing signal set to obtain a second sensing signal set; transmitting the second sensing signal set to a predetermined intermediate terminal according to a predetermined 5G signal transmission technology; correspondingly transmitting by the intermediate terminal the second sensing signal set to a predetermined simulation apparatus, acquiring by the intermediate terminal physiological feature signals to obtain a physiological feature signal set; if the physiological feature signal set does not exceed a preset standard, then transmitting the second sensing signal set to an elderly-person terminal; correspondingly transmitting by the elderly-person terminal the second sensing signal set to a second restorer cluster.

6 Claims, 3 Drawing Sheets

METHOD FOR IMPROVING HEALTH OF ELDERLY PERSON BASED ON 5G SIGNAL TRANSMISSION TECHNOLOGY

TECHNICAL FIELD

The present application relates to the field of computers, and more particularly to a method and apparatus for improving health of an elderly person based on a 5G signal transmission technology, a computer device, and a storage medium.

BACKGROUND

An elderly person is old and frail, and needs to be nursed in various aspects to ensure health. Tour has a positive impact on human health (including physical and mental health). However, an elderly person does not have enough vigor to complete an actual tour due to the poor physical status thereof. Tour experience would be very beneficial to the health of an elderly person. However, the prior art does not have the technical solution for an elderly person to experience a tour (because the elderly cannot go on a real tour due to the physical status).

SUMMARY

The present application provides a method for improving health of an elderly person based on a 5G signal transmission technology, including the following steps:

S1, utilizing by a real terminal a predetermined sensor cluster on the real terminal to acquire a first sensing signal set during a tour of a user corresponding to the real terminal;

S2, modifying by the real terminal the first sensing signal set according to a predetermined sensing signal modification method, so as to obtain a second sensing signal set;

S3, transmitting by the real terminal the second sensing signal set to a predetermined intermediate terminal according to a predetermined 5G signal transmission technology, wherein an age of a user corresponding to the intermediate terminal is in a preset first age interval;

S4, correspondingly transmitting by the intermediate terminal the second sensing signal set to a predetermined first restorer cluster on a predetermined simulation apparatus, such that the first restorer cluster restores the second sensing signal set to be original signals, wherein the simulation apparatus is worn on the user corresponding to the intermediate terminal, and a position of the first restorer cluster relative to the user corresponding to the intermediate terminal is the same as a position of the sensor cluster relative to the user corresponding to the real terminal;

S5, using by the intermediate terminal a predetermined physiological feature signal acquisition apparatus to acquire physiological feature signals of the user corresponding to the intermediate terminal, so as to obtain a physiological feature signal set;

S6, determining by the intermediate terminal whether the physiological feature signal set exceeds a preset standard according to a predetermined physiological feature determination method;

S7, if the physiological feature signal set does not exceed the preset standard, then transmitting the second sensing signal set to an elderly-person terminal according to the predetermined 5G signal transmission technology, wherein an age of a user corresponding to the elderly-person terminal is in a preset second age interval, and a minimum value of the second age interval is greater than a maximum value of the first age interval; and

S8, correspondingly transmitting by the elderly-person terminal the second sensing signal set to a predetermined second restorer cluster on a predetermined simulation cabin, such that the second restorer cluster restores the second sensing signal set to be original signals, wherein a space between the simulation cabin and the user corresponding to the elderly-person terminal is larger than a space between the simulation apparatus and the user corresponding to the intermediate terminal, and a buffer medium is disposed between the second restorer cluster and the user corresponding to the elderly-person terminal.

Further, step S2, modifying by the real terminal the first sensing signal set according to a predetermined sensing signal modification method, so as to obtain a second sensing signal set, includes:

S201, generating by the real terminal n time curves corresponding to n first sensing sub-signals according to the n first sensing sub-signals in the first sensing signal set, wherein the first sensing signal set totally comprises n first sensing sub-signal, and each first sensing sub-signal is continuous in time;

S202, calculating a first sensing curve F(t) according to the following formula $$F(t)=a1\times f1(t)+a2\times f2(t)+\ldots+an\times fn(t),$$

wherein a1, a2, . . . , and an are n preset parameters, and are all positive numbers, and f1(t), f2(t), . . . , and fn(t) are the n time curves;

S203, calculating time to be modified T according to the following formula T=argmax{min [F(t), H]}, wherein H is a preset contrast parameter, and H is greater than 0; and

S204, scaling down signal strengths of all the first sensing sub-signals in the time to be modified T so as to obtain modified first sensing sub-signals, and gathering all the modified first sensing sub-signals to form a second sensing signal set.

Further, step S4, correspondingly transmitting by the intermediate terminal the second sensing signal set to a predetermined first restorer cluster on a predetermined simulation apparatus, such that the first restorer cluster restores the second sensing signal set to be original signals, includes:

S401, acquiring by the intermediate terminal sensor models respectively corresponding to all the sub-signals in the second sensing signal set, and then acquiring a first corresponding relationship table between sensing signal strengths and original signal strengths according to the sensor models;

S402, acquiring models of all the restorers in the first restorer cluster, and then acquiring a second corresponding relationship table between the original signal strengths and control signal strengths according to the models of the restorers, wherein the first restorer cluster comprises at least a temperature restorer and a mechanical force generator;

S403, acquiring the control signal strengths respectively corresponding to all the restorers in the first restorer cluster according to the first corresponding relationship table and the second corresponding relationship table; and

S404, inputting the corresponding control signal strengths respectively into all the restorers in the first restorer cluster, such that the first restorer cluster restores the second sensing signal set to be original signals.

Further, step S6, determining by the intermediate terminal whether the physiological feature signal set exceeds a preset standard according to a predetermined physiological feature determination method, includes:

S601, calling from a predetermined database by the intermediate terminal m standard physiological curves showing how m standard physiological features of the user corresponding to the intermediate terminal vary with time, wherein the curves showing how the m standard physiological features vary with time respectively correspond to different types of physiological features;

S602, generating m real physiological curves showing how m physiological feature sub-signals in the physiological feature signal set respectively vary with time;

S603, obtaining a function sequence Q1(t), Q2(t), . . . , and Qm(t) according to the following formula Qi(t)=min(Gi(t), v), wherein $$Gi(t) = r \times |Ei(t)| + b \times \left|\frac{dEi(t)}{dt}\right|,$$

Ei(t)=Pi(t)−Ui(t), i is an integer from 1 to m, Pi(t) is the i-th standard physiological curve, Ui(t) is the i-th real physiological curve, $$\frac{dEi(t)}{dt}$$

is a difference function of time, t is time, v is a preset error parameter greater than 0, r and b are both preset coefficients greater than 0;

S604, determining whether Q1(t), Q2(t), . . . , and Qm(t) in the function sequence are all less than v; and S605, if Q1(t), Q2(t), . . . , and Qm(t) in the function sequence are all less than v, then determining that the physiological feature signal set does not exceed the preset standard.

Further, after step S6, determining by the intermediate terminal whether the physiological feature signal set exceeds a preset standard according to a predetermined physiological feature determination method, the method further includes:

S61, if the physiological feature signal set exceeds the preset standard, then attenuating by the intermediate terminal the second sensing signal set according to a data attenuation method, so as to attenuate the second sensing signal set to be a third sensing signal set;

S62, transmitting the third sensing signal set to the elderly-person terminal according to the predetermined 5G signal transmission technology, wherein the age of the user corresponding to the elderly-person terminal is in the preset second age interval, and the minimum value of the second age interval is greater than the maximum value of the first age interval; and S63, correspondingly transmitting by the elderly-person terminal the third sensing signal set to the predetermined second restorer cluster on the predetermined simulation cabin, such that the second restorer cluster restores the third sensing signal set to be original signals, wherein the space between the simulation cabin and the user corresponding to the elderly-person terminal is larger than the space between the simulation apparatus and the user corresponding to the intermediate terminal, and the buffer medium is disposed between the second restorer cluster and the user corresponding to the elderly-person terminal.

The present application provides an apparatus for improving health of an elderly person based on a 5G signal transmission technology, including:

a first sensing signal acquisition unit, for utilizing a predetermined sensor cluster on a real terminal to acquire a first sensing signal set during a tour of a user corresponding to the real terminal;

a sensing signal modification unit, for modifying the first sensing signal set according to a predetermined sensing signal modification method, so as to obtain a second sensing signal set;

a second sensing signal set transmitting unit, for transmitting the second sensing signal set to a predetermined intermediate terminal according to a predetermined 5G signal transmission technology, wherein an age of a user corresponding to the intermediate terminal is in a preset first age interval;

a first restorer cluster restoration unit, for correspondingly transmitting the second sensing signal set to a predetermined first restorer cluster on a predetermined simulation apparatus, such that the first restorer cluster restores the second sensing signal set to be original signals, wherein the simulation apparatus is worn on the user corresponding to the intermediate terminal, and a position of the first restorer cluster relative to the user corresponding to the intermediate terminal is the same as a position of the sensor cluster relative to the user corresponding to the real terminal;

a physiological feature signal acquisition unit, for using a predetermined physiological feature signal acquisition apparatus to acquire physiological feature signals of the user corresponding to the intermediate terminal, so as to obtain a physiological feature signal set;

a physiological feature signal set determination unit, for determining by the intermediate terminal whether the physiological feature signal set exceeds a preset standard according to a predetermined physiological feature determination method;

a second sensing signal set transmitting unit, for transmitting the second sensing signal set to an elderly-person terminal according to the predetermined 5G signal transmission technology if the physiological feature signal set does not exceed the preset standard, wherein an age of a user corresponding to the elderly-person terminal is in a preset second age interval, and a minimum value of the second age interval is greater than a maximum value of the first age interval; and a second restorer cluster restoration unit, for correspondingly transmitting the second sensing signal set to a predetermined second restorer cluster on a predetermined simulation cabin, such that the second restorer cluster restores the second sensing signal set to be original signals, wherein a space between the simulation cabin and the user corresponding to the elderly-person terminal is larger than a space between the simulation apparatus and the user corresponding to the intermediate terminal, and a buffer medium is disposed between the second restorer cluster and the user corresponding to the elderly-person terminal.

The present application provides a computer device. The computer device includes a memory and a processor, wherein the memory stores a computer program, and the processor implements the steps of any one of the above methods when executing the computer program.

The present application provides a computer readable storage medium, storing a computer program therein; when the computer program is executed by a processor, the steps of the methods as claimed in any one of the above embodiments are realized.

In the method and apparatus for improving health of an elderly person based on a 5G signal transmission technology, the computer device, and the storage medium, the present application utilizes three progressive terminals to screen the sensing signal sets in three steps on the basis of the 5G signal transmission technology, thereby enabling an elderly person to experience a tour, and benefiting the health of the elderly, wherein the three progressive terminals, the 5G signal transmission technology, and the three-step signal screening are all indispensable parts of the present application; specifically, the designs of the three progressive terminals and the three-step signal screening avoid the elderly from experiencing real tour signals having not been attenuated (for example, for an exciting tour activity such as rafting, the first-hand real tour signals are too exciting for the elderly to bear);

the 5G signal transmission technology has the features of high transmission rate and large transmitted data volume; therefore, a sensing signal set which is large in data volume can be sequentially transmitted from the real terminal to the intermediate terminal and finally to the elderly-person terminal, thereby having a good instant experience effect (if a signal transmission technology with a low transmission rate is used, then the status of signal delay is inevitable, in which case the subsequent restored signal would distort, thus losing the original intention of the present application, and having no desired effect). In addition, the present application further uses the progressive simulation apparatus and the simulation cabin, wherein the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal, thereby further preventing an elderly person from being negatively affected, and improve applicability.

The implementation of objectives, functional characteristics, and advantages of the present application will be further described with reference to the accompanying drawings.

DETAILED DESCRIPTION OF THE EMBODIMENTS

To make the objective, technical solution, and advantages of the present application be clearer, the present application will be further described in detail below with reference to the accompanying drawings and embodiments. It should be understood that the specific embodiments described herein are merely used to explain the present application, but are not intended to limit the present application.

Figure 1:
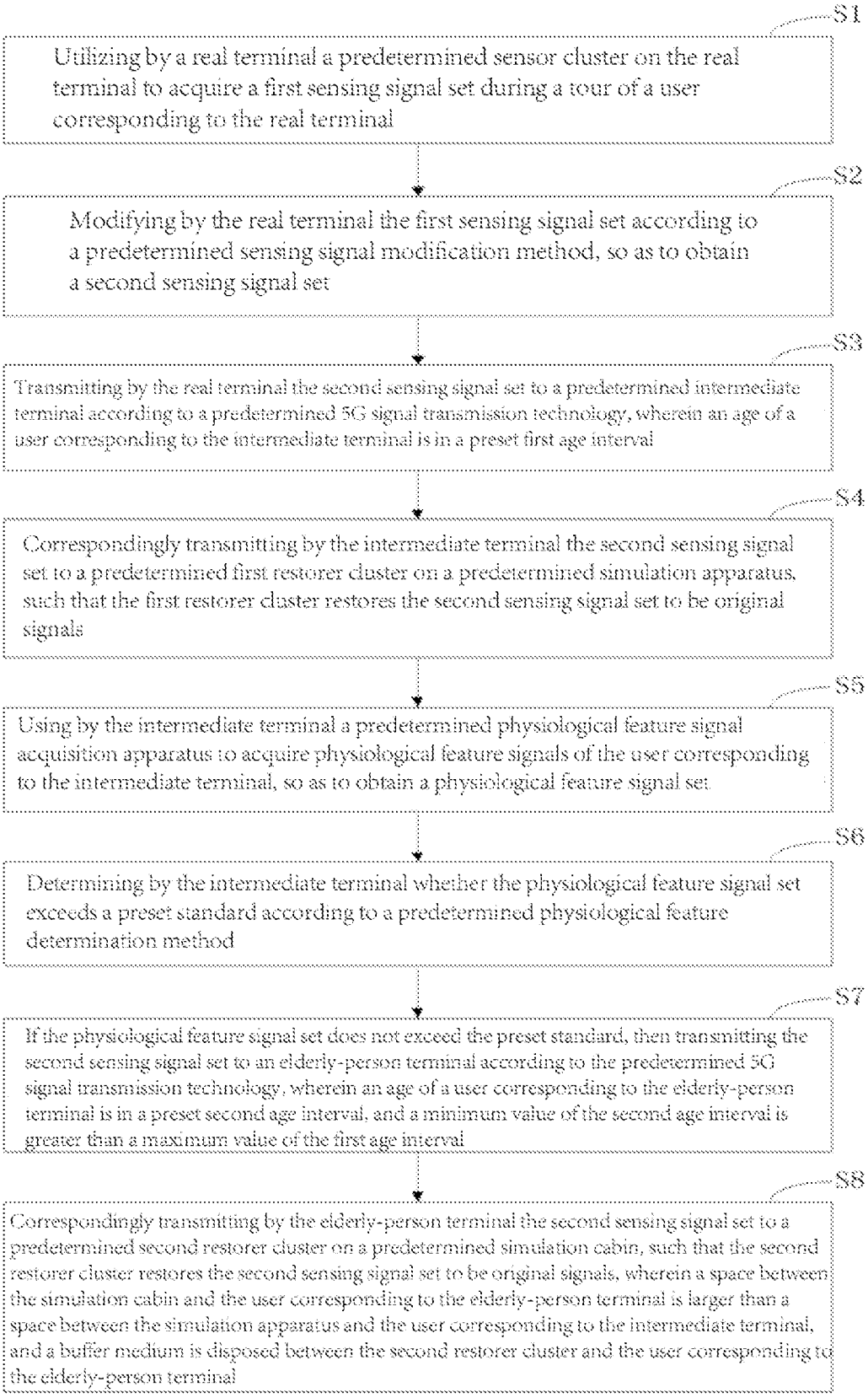
FIG. 1 is a flow chart of a method for improving health of an elderly person based on a 5G signal transmission technology according to one embodiment of the present application.

With reference to FIG. 1, an embodiment of the present application provides a method for improving health of an elderly person based on a 5G signal transmission technology, including the following steps:

S1, utilizing by a real terminal a predetermined sensor cluster on the real terminal to acquire a first sensing signal set during a tour of a user corresponding to the real terminal;

S2, modifying by the real terminal the first sensing signal set according to a predetermined sensing signal modification method, so as to obtain a second sensing signal set;

S3, transmitting by the real terminal the second sensing signal set to a predetermined intermediate terminal according to a predetermined 5G signal transmission technology, wherein an age of a user corresponding to the intermediate terminal is in a preset first age interval;

S4, correspondingly transmitting by the intermediate terminal the second sensing signal set to a predetermined first restorer cluster on a predetermined simulation apparatus, such that the first restorer cluster restores the second sensing signal set to be original signals, wherein the simulation apparatus is worn on the user corresponding to the intermediate terminal, and a position of the first restorer cluster relative to the user corresponding to the intermediate terminal is the same as a position of the sensor cluster relative to the user corresponding to the real terminal;

S5, using by the intermediate terminal a predetermined physiological feature signal acquisition apparatus to acquire physiological feature signals of the user corresponding to the intermediate terminal, so as to obtain a physiological feature signal set;

S6, determining by the intermediate terminal whether the physiological feature signal set exceeds a preset standard according to a predetermined physiological feature determination method;

S7, if the physiological feature signal set does not exceed the preset standard, then transmitting the second sensing signal set to an elderly-person terminal according to the predetermined 5G signal transmission technology, wherein an age of a user corresponding to the elderly-person terminal is in a preset second age interval, and a minimum value of the second age interval is greater than a maximum value of the first age interval; and S8, correspondingly transmitting by the elderly-person terminal the second sensing signal set to a predetermined second restorer cluster on a predetermined simulation cabin, such that the second restorer cluster restores the second sensing signal set to be original signals, wherein a space between the simulation cabin and the user corresponding to the elderly-person terminal is larger than a space between the simulation apparatus and the user corresponding to the intermediate terminal, and a buffer medium is disposed between the second restorer cluster and the user corresponding to the elderly-person terminal.

The present application uses the three-terminal design; different executive agents are provided at different stages; specifically, the executive agents are respectively the real terminal, the intermediate terminal, and the elderly-person terminal.

As described in steps S1-S3, a real terminal utilizes a predetermined sensor cluster on the real terminal to acquire a first sensing signal set during a tour of a user corresponding to the real terminal; the real terminal modifies the first sensing signal set according to a predetermined sensing signal modification method, so as to obtain a second sensing signal set; and the real terminal transmits the second sensing signal set to a predetermined intermediate terminal according to a predetermined 5G signal transmission technology, wherein an age of a user corresponding to the intermediate terminal is in a preset first age interval. The real terminal refers to a mobile terminal held by a user experiencing a real tour, and is an acquirer of all original data. The sensor cluster includes any feasible sensors, such as a temperature sensor, a piezoelectric sensor, an image sensor (for acquiring an image by means of a camera to obtain a picture or a video signal), a sound sensor, and/or an odor sensor. The tour in the present application refers to the travel behavior of a user, and may include regular play or irregular play, wherein the regular play includes roller coaster and ferris wheel in an amusement park; and the irregular play includes rafting, mountaineering and the like. The first sensing signal set corresponds to the sensor cluster, that is, if the sensor cluster includes a temperature sensor, then the first sensing signal set includes temperature sensing sub-signals, such that the first sensing signal set can reflect tour experience of the user; the more the number of the sensors in the sensor cluster is, the richer the types are, then the higher the accuracy that the first sensor signal set reflects the tour experience would be. The sensing signals can be modified with any feasible methods, with the purpose of modifying screechy sensing signals, so as to prevent the elderly person corresponding to the elderly-person terminal from being stimulated by the too screechy sensing signals during tour experience under the method of the present application, because the screechy signals are harmful to health. Furthermore, the second sensing signal set is transmitted to a predetermined intermediate terminal according to a predetermined 5G signal transmission technology. It should be noted that the reason why the present application uses the 5G signal transmission technology is that the present application needs to transmit the massive complex second sensing signal set to the predetermined intermediate terminal. And common signal transmission technologies, such as a 4G signal transmission technology, cannot satisfy the requirement of the present application because the signal transmission efficiency thereof is far lower than that of the 5G technology. It should be noted herein that the signal to be transmitted in the present application further includes a video image signal the transmission of which also needs the support of the 5G signal transmission technology; furthermore, the video image signal may exist in two different forms; one is that the video image signal is contained in the first sensing signal set, that is, as a sub-signal in the first sensing signal set; the other one is that the video image signal is in parallel with the first sensor signal set, and is also transmitted to the intermediate terminal when the first sensor signal set is modified and transmitted.

Further, step S2, modifying by the real terminal the first sensing signal set according to a predetermined sensing signal modification method, so as to obtain a second sensing signal set, includes:

S201, generating by the real terminal n time curves corresponding to n first sensing sub-signals according to the n first sensing sub-signals in the first sensing signal set, wherein the first sensing signal set totally comprises n first sensing sub-signal, and each first sensing sub-signal is continuous in time;

S202, calculating a first sensing curve F(t) according to the following formula $$F(t)=a1\times f1(t)+a2\times f2(t)+\ldots+an\times fn(t),$$

wherein a1, a2, . . . , and an are n preset parameters, and are all positive numbers, and f1(t), f2(t), . . . , and fn(t) are the n time curves;

S203, calculating time to be modified T according to the following formula T=argmax{min [F(t), H]}, wherein H is a preset contrast parameter, and H is greater than 0; and

S204, scaling down signal strengths of all the first sensing sub-signals in the time to be modified T so as to obtain modified first sensing sub-signals, and gathering all the modified first sensing sub-signals to form a second sensing signal set.

Therefore, the screechy signals in the first sensing signal set are attenuated, so as to prevent the signals from hurting the elderly person subsequently. The present application uses the following formula $$F(t)=a1\times f1(t)+a2\times f2(t)+\ldots+an\times fn(t),$$

to calculate the first sensing curve F(t), and then calculates the time to be modified T according to the formula T=argmax{min[F(t), H]}, so as to accurately and comprehensively calculate the time to be modified T corresponding to the screechy signals. And finally, the signals corresponding to the time to be modified T are scaled down without processing the signals corresponding to the other time periods.

As described in steps S4-S7, the intermediate terminal correspondingly transmits the second sensing signal set to the predetermined first restorer cluster on the predetermined simulation apparatus, such that the first restorer cluster restores the second sensing signal set to be original signals, wherein the simulation apparatus is worn on the user corresponding to the intermediate terminal, and the position of the first restorer cluster relative to the user corresponding to the intermediate terminal is the same as the position of the sensor cluster relative to the user corresponding to the real terminal; the intermediate terminal uses a predetermined physiological feature signal acquisition apparatus to acquire physiological feature signals of the user corresponding to the intermediate terminal, so as to obtain a physiological feature signal set; the intermediate terminal determines whether the physiological feature signal set exceeds a preset standard according to a predetermined physiological feature determination method; and if the physiological feature signal set does not exceed the preset standard, then transmitting the second sensing signal set to an elderly-person terminal according to the predetermined 5G signal transmission technology, wherein an age of the user corresponding to the elderly-person terminal is in a preset second age interval, and the minimum value of the second age interval is greater than the maximum value of the first age interval. It should be emphasized herein that in order to prevent the elderly person from being hurt while providing enjoyable tour experience, the present application adopts various cushion designs, for example, modifying the signals, and designing an intermediate terminal for further cushion. The age of the user of the intermediate terminal is limited; that is, the user of the intermediate terminal should be younger than the user corresponding to the elderly-person terminal. The reason why the intermediate terminal is used is that if the user of the intermediate terminal cannot bear the original signals restored from the second sensing signal set, then the user of the elderly-person terminal cannot bear the original signals either, so as to prevent the elderly person from being hurt in advance. The first restorer cluster corresponds to the second sensing signal set, that is, if the second sensing signal set includes a temperature signal, then the first restorer cluster includes a temperature generator, so as to simulate real original signals; if the second sensing signal set includes a pressure signal (for example, being rushed by a water flow during rafting), then the first restorer cluster is provided with a mechanical force generator (for example, a motor, or an anti-piezoelectric device) at a position corresponding to a human body, so as to simulate water flow rush and the like; and if the second sensing signal set includes an odor signal (for example, during viewing in a garden), then the first restorer cluster includes an odor generator (for example, an odor molecule transmitter). In such way, whether the user of the intermediate terminal can bear the original signals can be determined; the present application uses the physiological feature signal as a basis; that is, the intermediate terminal uses a predetermined physiological feature signal acquisition apparatus to acquire physiological feature signals of the user corresponding to the intermediate terminal, so as to obtain a physiological feature signal set; then the intermediate terminal determines whether the physiological feature signal set exceeds a preset standard according to a predetermined physiological feature determination method; if the physiological feature signal set does not exceed the preset standard, then the intermediate terminal transmits the second sensing signal set to the elderly-person terminal according to the predetermined 5G signal transmission technology. In this case, if the physiological feature signal set does not exceed the preset standard, the user of the intermediate terminal can bear the second sensing signal set. Therefore, the second sensing signal set is transmitted to the elderly-person terminal according to the predetermined 5G signal transmission technology. Further, the age of user of the intermediate terminal is greater than that of the user of the real terminal. The simulation apparatus can be any feasible apparatuses, such as a wearable simulation apparatus (in which the first restorer cluster is arranged), and can also be an apparatus having a fixed accommodation space in which the user is located.

Further, step S4, correspondingly transmitting by the intermediate terminal the second sensing signal set to a predetermined first restorer cluster on a predetermined simulation apparatus, such that the first restorer cluster restores the second sensing signal set to be original signals, includes:

S401, acquiring by the intermediate terminal sensor models respectively corresponding to all the sub-signals in the second sensing signal set, and then acquiring a first corresponding relationship table between sensing signal strengths and original signal strengths according to the sensor models;

S402, acquiring models of all the restorers in the first restorer cluster, and then acquiring a second corresponding relationship table between the original signal strengths and control signal strengths according to the models of the restorers, wherein the first restorer cluster comprises at least a temperature restorer and a mechanical force generator;

S403, acquiring the control signal strengths respectively corresponding to all the restorers in the first restorer cluster according to the first corresponding relationship table and the second corresponding relationship table; and

S404, inputting the corresponding control signal strengths respectively into all the restorers in the first restorer cluster, such that the first restorer cluster restores the second sensing signal set to be original signals.

Therefore, the second sensing signal set is converted into original signals, and the original signals are then converted into control signals, such that all the restorers in the first restorer cluster respectively accurately restore all the sub-signals in the second sensing signal set to be original signals.

Further, step S6, determining by the intermediate terminal whether the physiological feature signal set exceeds a preset standard according to a predetermined physiological feature determination method, includes:

S601, calling from a predetermined database by the intermediate terminal m standard physiological curves showing how m standard physiological features of the user corresponding to the intermediate terminal vary with time, wherein the curves showing how the m standard physiological features vary with time respectively correspond to different types of physiological features;

S602, generating m real physiological curves showing how m physiological feature sub-signals in the physiological feature signal set respectively vary with time;

S603, obtaining a function sequence Q1(t), Q2(t), . . . , and Qm(t) according to the following formula Qi(t)=min(Gi(t), v), wherein $$Gi(t) = r \times |Ei(t)| + b \times \left|\frac{dEi(t)}{dt}\right|,$$

Ei(t)=Pi(t)−Ui(t), i is an integer from 1 to m, Pi(t) is the i-th standard physiological curve, Ui(t) is the i-th real physiological curve, $$\frac{dEi(t)}{dt}$$

is a difference function of time, t is time, v is a preset error parameter greater than 0, r and b are both preset coefficients greater than 0;

S604, determining whether Q1(t), Q2(t), . . . , and Qm(t) in the function sequence are all less than v; and

S605, if Q1(t), Q2(t), . . . , and Qm(t) in the function sequence are all less than v, then determining that the physiological feature signal set does not exceed the preset standard.

Therefore, whether the physiological feature signal set exceeds the preset standard is determined according to the predetermined physiological feature determination method. The present application uses a special physiological feature determination method, that is, the function sequence Q1(t), Q2(t), . . . , and Qm(t) is obtained by the following formula:

Qi(t)=min (Gi(t), v), wherein $$Gi(t) = r \times |Ei(t)| + b \times \left|\frac{dEi(t)}{dt}\right|,$$

Ei(t)=Pi(t)−Ui(t), and i is an integer from 1 to m. The adverse effect of too big value on the elderly, and the adverse effect of too quick value change on the elderly are both considered, such that the final determination result is more accurate, so as to ensure the health of the elderly.

Further, after step S6, determining by the intermediate terminal whether the physiological feature signal set exceeds a preset standard according to a predetermined physiological feature determination method, the method further includes:

S61, if the physiological feature signal set exceeds the preset standard, then attenuating by the intermediate terminal the second sensing signal set according to a data attenuation method, so as to attenuate the second sensing signal set to be a third sensing signal set;

S62, transmitting the third sensing signal set to the elderly-person terminal according to the predetermined 5G signal transmission technology, wherein the age of the user corresponding to the elderly-person terminal is in the preset second age interval, and the minimum value of the second age interval is greater than the maximum value of the first age interval; and

S63, correspondingly transmitting by the elderly-person terminal the third sensing signal set to the predetermined second restorer cluster on the predetermined simulation cabin, such that the second restorer cluster restores the third sensing signal set to be original signals, wherein the space between the simulation cabin and the user corresponding to the elderly-person terminal is larger than the space between the simulation apparatus and the user corresponding to the intermediate terminal, and the buffer medium is disposed between the second restorer cluster and the user corresponding to the elderly-person terminal.

Therefore, when the intermediate terminal finds that the second sensing signal set can still hurt the elderly, the second sensing signal set is attenuated with the predetermined data attenuation method, so as to ensure the health and safety of the elderly. The data attenuation method can be any feasible methods, such as scaling down all the sub-signals in the second sensing signal set, in which case the elderly person can still obtain a certain tour experience, while ensuring the health of the elderly.

As described in step S8, the elderly-person terminal correspondingly transmits the second sensing signal set to the predetermined second restorer cluster on the predetermined simulation cabin, such that the second restorer cluster restores the second sensing signal set to be original signals, wherein the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal. After the second sensing signal set is received, the elderly-person terminal correspondingly transmits the second sensing signal set to the predetermined second restorer cluster on the predetermined simulation cabin, such that the second restorer cluster restores the second sensing signal set to be original signals. Therefore, the elderly person can experience a tour by means of the simulation cabin. The second restorer cluster is similar to the first restorer cluster. The small difference, which is another special design of the present application, is that the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal. With such design, the present application can further realize physical cushion on the basis of the original three buffer terminals, so as to further ensure the health and safety of the elderly. Specifically, the body constitution of the elderly is objectively weaker than the young; therefore, the simulation cabin is different from the simulation apparatus, that is, the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal; in summary, the simulation cabin realizes physical cushion by means of larger space and the buffer medium. The buffer medium is different according to different second sensing signal sets and different second restorer clusters, that is, the buffer medium is correspondingly provided. For example, when the sub-signal in the second sensing signal set is a piezoelectric signal (that is, the original signal is a pressure signal), the buffer medium corresponding to the position of the piezoelectric signal can be an elastic absorption material; and when the sub-signal in the second sensing signal set is a temperature signal, the buffer medium corresponding to the position of the temperature signal can be a thermal buffer material (for example, the material with low thermal conductivity, and the materials with a high thermal conductivity such as metal are not suitable). Therefore, the health of an elderly person is improved on the basis of the 5G signal transmission technology.

In the method for improving health of an elderly person based on a 5G signal transmission technology, the present application utilizes three progressive terminals to screen the sensing signal sets in three steps on the basis of the 5G signal transmission technology, thereby enabling an elderly person to experience a tour, and benefiting the health of the elderly, wherein the three progressive terminals, the 5G signal transmission technology, and the three-step signal screening are all indispensable parts of the present application; specifically, the designs of the three progressive terminals and the three-step signal screening avoid the elderly from experiencing real tour signals having not been attenuated (for example, for an exciting tour activity such as rafting, the first-hand real tour signals are too exciting for the elderly to bear); the 5G signal transmission technology has the features of high transmission rate and large transmitted data volume; therefore, a sensing signal set which is large in data volume can be sequentially transmitted from the real terminal to the intermediate terminal and finally to the elderly-person terminal, thereby having a good instant experience effect (if a signal transmission technology with a low transmission rate is used, then the status of signal delay is inevitable, in which case the subsequent restored signal would distort, thus losing the original intention of the present application, and having no desired effect). In addition, the present application further uses the progressive simulation apparatus and the simulation cabin, wherein the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal, thereby further preventing an elderly person from being negatively affected, and improve applicability.

Figure 2:
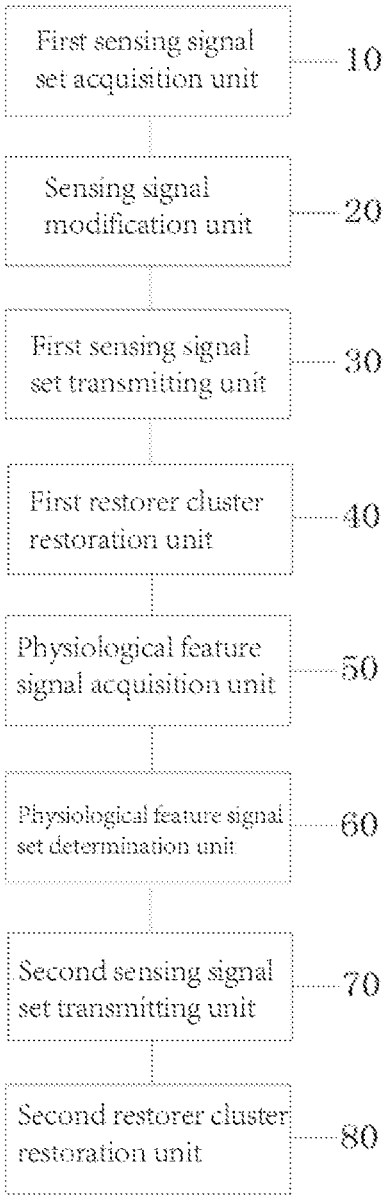
FIG. 2 is a structural schematic view of an apparatus for improving health of an elderly person based on a 5G signal transmission technology according to one embodiment of the present application.

With reference to FIG. 2, an embodiment of the present application provides an apparatus for improving health of an elderly person based on a 5G signal transmission technology, including:

a first sensing signal acquisition unit 10, for utilizing a predetermined sensor cluster on a real terminal to acquire a first sensing signal set during a tour of a user corresponding to the real terminal;

a sensing signal modification unit 20, for modifying the first sensing signal set according to a predetermined sensing signal modification method, so as to obtain a second sensing signal set;

a first sensing signal set transmitting unit 30, for transmitting the second sensing signal set to a predetermined intermediate terminal according to a predetermined 5G signal transmission technology, wherein an age of a user corresponding to the intermediate terminal is in a preset first age interval;

a first restorer cluster restoration unit 40, for correspondingly transmitting the second sensing signal set to a predetermined first restorer cluster on a predetermined simulation apparatus, such that the first restorer cluster restores the second sensing signal set to be original signals, wherein the simulation apparatus is worn on the user corresponding to the intermediate terminal, and a position of the first restorer cluster relative to the user corresponding to the intermediate terminal is the same as a position of the sensor cluster relative to the user corresponding to the real terminal;

a physiological feature signal acquisition unit 50, for using a predetermined physiological feature signal acquisition apparatus to acquire physiological feature signals of the user corresponding to the intermediate terminal, so as to obtain a physiological feature signal set;

a physiological feature signal set determination unit 60, for determining by the intermediate terminal whether the physiological feature signal set exceeds a preset standard according to a predetermined physiological feature determination method;

a second sensing signal set transmitting unit 70, for transmitting the second sensing signal set to an elderly-person terminal according to the predetermined 5G signal transmission technology if the physiological feature signal set does not exceed the preset standard, wherein an age of a user corresponding to the elderly-person terminal is in a preset second age interval, and a minimum value of the second age interval is greater than a maximum value of the first age interval; and a second restorer cluster restoration unit 80, for correspondingly transmitting the second sensing signal set to a predetermined second restorer cluster on a predetermined simulation cabin, such that the second restorer cluster restores the second sensing signal set to be original signals, wherein a space between the simulation cabin and the user corresponding to the elderly-person terminal is larger than a space between the simulation apparatus and the user corresponding to the intermediate terminal, and a buffer medium is disposed between the second restorer cluster and the user corresponding to the elderly-person terminal.

The operations executed by the above units are in one-to-one correspondence with the steps of the method for improving health of an elderly person based on a 5G signal transmission technology described in the aforementioned embodiments, and will not be repeated here.

In the apparatus for improving health of an elderly person based on a 5G signal transmission technology, the present application utilizes three progressive terminals to screen the sensing signal sets in three steps on the basis of the 5G signal transmission technology, thereby enabling an elderly person to experience a tour, and benefiting the health of the elderly, wherein the three progressive terminals, the 5G signal transmission technology, and the three-step signal screening are all indispensable parts of the present application; specifically, the designs of the three progressive terminals and the three-step signal screening avoid the elderly from experiencing real tour signals having not been attenuated (for example, for an exciting tour activity such as rafting, the first-hand real tour signals are too exciting for the elderly to bear); the 5G signal transmission technology has the features of high transmission rate and large transmitted data volume; therefore, a sensing signal set which is large in data volume can be sequentially transmitted from the real terminal to the intermediate terminal and finally to the elderly-person terminal, thereby having a good instant experience effect (if a signal transmission technology with a low transmission rate is used, then the status of signal delay is inevitable, in which case the subsequent restored signal would distort, thus losing the original intention of the present application, and having no desired effect). In addition, the present application further uses the progressive simulation apparatus and the simulation cabin, wherein the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal, thereby further preventing an elderly person from being negatively affected, and improve applicability.

Figure 3:
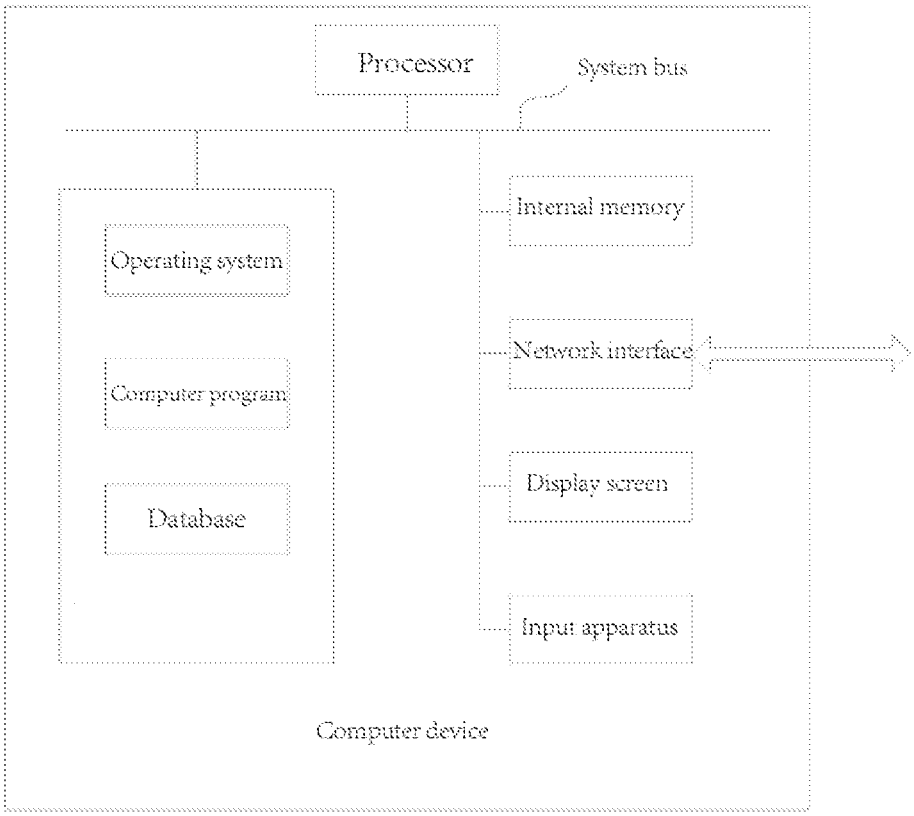
FIG. 3 is a structural schematic view of a computer device according to one embodiment of the present application.

With reference to FIG. 3, an embodiment of the present invention further provides a computer device; the computer device can be a server, and the internal structure thereof can be as shown in the figure. The computer device includes a processor, a memory, a network interface and a database which are connected through a system bus. The processor of the computer device is configured to provide computing and control capabilities. The memory of the computer device includes a nonvolatile storage medium and an internal memory. The nonvolatile storage medium stores an operating system, a computer program, and a database. The internal memory provides an environment for operations of the operating system and the computer program in the nonvolatile storage medium. The database of the computer device is used to store data used for the method for improving health of an elderly person based on a 5G signal transmission technology. The network interface of the computer device is configured to communicate with an external terminal through a network. When the computer program is executed by the processor, a method for improving health of an elderly person based on a 5G signal transmission technology is realized.

The process executes the method for improving health of an elderly person based on a 5G signal transmission technology, wherein the steps of the method are in one-to-one correspondence with the steps of the method for improving health of an elderly person based on a 5G signal transmission technology described in the aforementioned embodiments, and will not be repeated here.

A person skilled in the art can understand that the structure shown in the figure is only a block diagram of a part of the structures related to the solution of the present application, but is not intended to limit the computer device to which the solution of the present application is applied.

The computer device of the present application utilizes three progressive terminals to screen the sensing signal sets in three steps on the basis of the 5G signal transmission technology, thereby enabling an elderly person to experience a tour, and benefiting the health of the elderly, wherein the three progressive terminals, the 5G signal transmission technology, and the three-step signal screening are all indispensable parts of the present application; specifically, the designs of the three progressive terminals and the three-step signal screening avoid the elderly from experiencing real tour signals having not been attenuated (for example, for an exciting tour activity such as rafting, the first-hand real tour signals are too exciting for the elderly to bear); the 5G signal transmission technology has the features of high transmission rate and large transmitted data volume; therefore, a sensing signal set which is large in data volume can be sequentially transmitted from the real terminal to the intermediate terminal and finally to the elderly-person terminal, thereby having a good instant experience effect (if a signal transmission technology with a low transmission rate is used, then the status of signal delay is inevitable, in which case the subsequent restored signal would distort, thus losing the original intention of the present application, and having no desired effect). In addition, the present application further uses the progressive simulation apparatus and the simulation cabin, wherein the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal, thereby further preventing an elderly person from being negatively affected, and improve applicability.

An embodiment of the present application further provides a computer readable storage medium, storing a computer program; when the computer program is executed by a processor, a method for improving health of an elderly person based on a 5G signal transmission technology is realized, wherein the steps of the method are in one-to-one correspondence with the steps of the method for improving health of an elderly person based on a 5G signal transmission technology described in the aforementioned embodiments, and will not be repeated here.

The computer readable storage medium of the present application utilizes three progressive terminals to screen the sensing signal sets in three steps on the basis of the 5G signal transmission technology, thereby enabling an elderly person to experience a tour, and benefiting the health of the elderly, wherein the three progressive terminals, the 5G signal transmission technology, and the three-step signal screening are all indispensable parts of the present application; specifically, the designs of the three progressive terminals and the three-step signal screening avoid the elderly from experiencing real tour signals having not been attenuated (for example, for an exciting tour activity such as rafting, the first-hand real tour signals are too exciting for the elderly to bear); the 5G signal transmission technology has the features of high transmission rate and large transmitted data volume; therefore, a sensing signal set which is large in data volume can be sequentially transmitted from the real terminal to the intermediate terminal and finally to the elderly-person terminal, thereby having a good instant experience effect (if a signal transmission technology with a low transmission rate is used, then the status of signal delay is inevitable, in which case the subsequent restored signal would distort, thus losing the original intention of the present application, and having no desired effect). In addition, the present application further uses the progressive simulation apparatus and the simulation cabin, wherein the space between the simulation cabin and the user corresponding to the elderly-person terminal is larger than the space between the simulation apparatus and the user corresponding to the intermediate terminal, and a buffer medium is disposed between the second restorer cluster and the user corresponding to the elderly-person terminal, thereby further preventing an elderly person from being negatively affected, and improve applicability.

A person skilled in the art can understand that the whole or a part of the flows realizing the method in the above embodiments can be completed by means of a computer program or by instructing relevant hardware; the computer program can be stored in a non-volatile computer readable storage medium; when the computer program is executed, the flows of the method in the above embodiments are executed. The memory, storage medium, database, and any other mediums used in the embodiments of the present application can all include a non-volatile and/or a volatile memory. The non-volatile memory may include a read-only memory (ROM), a programmable ROM (PROM), an electrically-programmable ROM (EPROM), an electrically-erasable programmable ROM (EEPROM), and a flash memory. The volatile memory may include a random access memory (RAM), and an external cache. As description but not limitation, various forms of RAMs are available, such as a static RAM (SRAM), a dynamic RAM (DRAM), a synchronous DRAM (SDRAM), a double data rate SDRAM (SSRSDRAM), an enhanced SDRAM (ESDRAM), a Synchlink DRAM (SLDRAM), a Rambus direct RAM (RDRAM), a direct Rambus dynamic RAM (DRDRAM), a Rambus dynamic RAM (RDRAM) and the like.

It should be noted that in the specification, the terms "include", "comprise" or any other variants thereof are intended to cover non-exclusive inclusion, such that a process, device, article or method including a series of elements not only includes those elements, but also includes other elements not explicitly listed, or further includes elements inherent to the process, device, article or method. In the absence of more restrictions, the element defined by the sentence "including a . . . " does not exclude the presence of other identical elements in the process, device, article or method including the element.

The descriptions above are only the preferred embodiments of the present application, but are not intended to limit the scope of the present application. Any equivalent structural or process transformations based on the content of the specification and the accompanying drawings of the present invention, or direct or indirect application of the above-described embodiments in other related technical fields are all concluded in the protection scope of the present invention for the same reason.

The invention claimed is:

1. A method for improving health of an elderly person based on a 5G signal transmission technology, comprising:

S1, utilizing by a real terminal a predetermined sensor cluster on the real terminal to acquire a first sensing signal set during a tour of a user corresponding to the real terminal;

S2, modifying by the real terminal the first sensing signal set according to a predetermined sensing signal modification method, so as to obtain a second sensing signal set;

S3, transmitting by the real terminal the second sensing signal set to a predetermined intermediate terminal according to a predetermined 5G signal transmission technology, wherein an age of a user corresponding to the intermediate terminal is in a preset first age interval;

S4, correspondingly transmitting by the intermediate terminal the second sensing signal set to a predetermined first restorer cluster on a predetermined simulation apparatus, such that the first restorer cluster restores the second sensing signal set to be original signals;

S5, using by the intermediate terminal a predetermined physiological feature signal acquisition apparatus to acquire physiological feature signals of the user corresponding to the intermediate terminal, so as to obtain a physiological feature signal set;

S6, determining by the intermediate terminal whether the physiological feature signal set exceeds a preset standard according to a predetermined physiological feature determination method;

S7, if the physiological feature signal set does not exceed the preset standard, then transmitting the second sensing signal set to an elderly-person terminal according to the predetermined 5G signal transmission technology, wherein an age of a user corresponding to the elderly-person terminal is in a preset second age interval, and a minimum value of the second age interval is greater than a maximum value of the first age interval; and S8, correspondingly transmitting by the elderly-person terminal the second sensing signal set to a predetermined second restorer cluster on a predetermined simulation cabin, such that the second restorer cluster restores the second sensing signal set to be original signals, wherein a space between the simulation cabin and the user corresponding to the elderly-person terminal is larger than a space between the simulation apparatus and the user corresponding to the intermediate terminal, and a buffer medium is disposed between the second restorer cluster and the user corresponding to the elderly-person terminal.

2. The method for improving health of an elderly person based on a 5G signal transmission technology according to claim 1, wherein step S2, modifying by the real terminal the first sensing signal set according to a predetermined sensing signal modification method, so as to obtain a second sensing signal set, comprises:

S201, generating by the real terminal n time curves corresponding to n first sensing sub-signals according to the n first sensing sub-signals in the first sensing signal set, wherein the first sensing signal set totally comprises n first sensing sub-signal, and each first sensing sub-signal is continuous in time;

S202, calculating a first sensing curve F(t) according to the following formula $$F(t)=a1\times f1(t)+a2\times f2(t)+\ldots+an\times fn(t),$$

wherein a1, a2, . . . , and an are n preset parameters, and are all positive numbers, and f1(t), f2(t), . . . , and fn(t) are the n time curves;

S203, calculating time to be modified T according to the following formula T=argmax{min [F(t), H]}, wherein H is a preset contrast parameter, and H is greater than 0; and S204, scaling down signal strengths of all the first sensing sub-signals in the time to be modified T so as to obtain modified first sensing sub-signals, and gathering all the modified first sensing sub-signals to form a second sensing signal set.

3. The method for improving health of an elderly person based on a 5G signal transmission technology according to claim 1, wherein step S4, correspondingly transmitting by the intermediate terminal the second sensing signal set to a predetermined first restorer cluster on a predetermined simulation apparatus, such that the first restorer cluster restores the second sensing signal set to be original signals, comprises:

S401, acquiring by the intermediate terminal sensor models respectively corresponding to all the sub-signals in the second sensing signal set, and then acquiring a first corresponding relationship table between sensing signal strengths and original signal strengths according to the sensor models;

S402, acquiring models of all the restorers in the first restorer cluster, and then acquiring a second corresponding relationship table between the original signal strengths and control signal strengths according to the models of the restorers, wherein the first restorer cluster comprises at least a temperature restorer and a mechanical force generator;

S403, acquiring the control signal strengths respectively corresponding to all the restorers in the first restorer cluster according to the first corresponding relationship table and the second corresponding relationship table; and S404, inputting the corresponding control signal strengths respectively into all the restorers in the first restorer cluster, such that the first restorer cluster restores the second sensing signal set to be original signals.

4. The method for improving health of an elderly person based on a 5G signal transmission technology according to claim 1, wherein step S6, determining by the intermediate terminal whether the physiological feature signal set exceeds a preset standard according to a predetermined physiological feature determination method, comprises:

S601, calling from a predetermined database by the intermediate terminal m standard physiological curves showing how m standard physiological features of the user corresponding to the intermediate terminal vary with time, wherein the curves showing how the m standard physiological features vary with time respectively correspond to different types of physiological features;

S602, generating m real physiological curves showing how m physiological feature sub-signals in the physiological feature signal set respectively vary with time;

S603, obtaining a function sequence Q1(t), Q2(t), . . . , and Qm(t) according to the following formula Qi(t)=min(Gi(t), v), wherein Ei(t)=Pi(t)−Ui(t), i is an integer from 1 to m, Pi(t) is the i-th standard physiological curve, Ui(t) is the i-th real physiological curve, is a difference function of time, t is time, v is a preset error parameter greater than 0, r and b are both preset coefficients greater than 0;

S604, determining whether Q1(t), Q2(t), . . . , and Qm(t) in the function sequence are all less than v; and S605, if Q1(t), Q2(t), . . . , and Qm(t) in the function sequence are all less than v, then determining that the physiological feature signal set does not exceed the preset standard.

5. The method for improving health of an elderly person based on a 5G signal transmission technology according to claim 1, wherein after step S6, determining by the intermediate terminal whether the physiological feature signal set exceeds a preset standard according to a predetermined physiological feature determination method, the method further comprises:

S61, if the physiological feature signal set exceeds the preset standard, then attenuating by the intermediate terminal the second sensing signal set according to a data attenuation method, so as to attenuate the second sensing signal set to be a third sensing signal set;

S62, transmitting the third sensing signal set to the elderly-person terminal according to the predetermined 5G signal transmission technology, wherein the age of the user corresponding to the elderly-person terminal is in the preset second age interval, and the minimum value of the second age interval is greater than the maximum value of the first age interval; and S63, correspondingly transmitting by the elderly-person terminal the third sensing signal set to the predetermined second restorer cluster on the predetermined simulation cabin, such that the second restorer cluster restores the third sensing signal set to be original signals, wherein the space between the simulation cabin and the user corresponding to the elderly-person terminal is larger than the space between the simulation apparatus and the user corresponding to the intermediate terminal, and the buffer medium is disposed between the second restorer cluster and the user corresponding to the elderly-person terminal.

6. An apparatus for improving health of an elderly person based on a 5G signal transmission technology, comprising:

a first sensing signal acquisition unit, for utilizing a predetermined sensor cluster on a real terminal to acquire a first sensing signal set during a tour of a user corresponding to the real terminal;

a sensing signal modification unit, for modifying the first sensing signal set according to a predetermined sensing signal modification method, so as to obtain a second sensing signal set;

a first sensing signal set transmitting unit, for transmitting the second sensing signal set to a predetermined intermediate terminal according to a predetermined 5G signal transmission technology, wherein an age of a user corresponding to the intermediate terminal is in a preset first age interval;

a first restorer cluster restoration unit, for correspondingly transmitting the second sensing signal set to a predetermined first restorer cluster on a predetermined simulation apparatus, such that the first restorer cluster restores the second sensing signal set to be original signals, wherein the simulation apparatus is worn on the user corresponding to the intermediate terminal, and a position of the first restorer cluster relative to the user corresponding to the intermediate terminal is the same as a position of the sensor cluster relative to the user corresponding to the real terminal;

a physiological feature signal acquisition unit, for using a predetermined physiological feature signal acquisition apparatus to acquire physiological feature signals of the user corresponding to the intermediate terminal, so as to obtain a physiological feature signal set;

a physiological feature signal set determination unit, for determining by the intermediate terminal whether the physiological feature signal set exceeds a preset standard according to a predetermined physiological feature determination method;

a second sensing signal set transmitting unit, for transmitting the second sensing signal set to an elderly-person terminal according to the predetermined 5G signal transmission technology if the physiological feature signal set does not exceed the preset standard, wherein an age of a user corresponding to the elderly-person terminal is in a preset second age interval, and a minimum value of the second age interval is greater than a maximum value of the first age interval; and a second restorer cluster restoration unit, for correspondingly transmitting the second sensing signal set to a predetermined second restorer cluster on a predetermined simulation cabin, such that the second restorer cluster restores the second sensing signal set to be original signals, wherein a space between the simulation cabin and the user corresponding to the elderly-person terminal is larger than a space between the simulation apparatus and the user corresponding to the intermediate terminal, and a buffer medium is disposed between the second restorer cluster and the user corresponding to the elderly-person terminal.

* * * * *